US005205213A

United States Patent [19]

Bresson

[11] Patent Number: 5,205,213

[45] Date of Patent: Apr. 27, 1993

[54] AXIALLY SYMMETRICAL GAPLESS LAYERED SLEEVE PRINTING BLANKET SYSTEM

[76] Inventor: Michel Bresson, 55 Hayden Ave., Lexington, Mass. 02173

[21] Appl. No.: 682,048

[22] Filed: Apr. 8, 1991

[30] Foreign Application Priority Data

Apr. 12, 1990 [FR] France ..... 90 04749

[51] Int. Cl.[5] ..... B41F 7/02

[52] U.S. Cl. ..... 101/217; 101/375; 428/909

[58] Field of Search ..... 101/217, 375, 376; 428/909

[56] References Cited

U.S. PATENT DOCUMENTS

| | | | |
|---|---|---|---|
| 1,608,206 | 11/1926 | Freedlander | 101/217 |
| 1,804,139 | 5/1931 | Adsit et al. | 101/217 |
| 2,054,620 | 9/1936 | Freedlander | 101/217 |
| 2,193,899 | 3/1940 | Casto et al. | 156/160 |
| 3,750,250 | 8/1973 | Brown | 29/211 |
| 3,983,287 | 9/1976 | Goossen et al. | 428/241 |
| 4,043,013 | 8/1977 | Zeppernick et al. | 29/132 |
| 4,043,142 | 8/1977 | Marshall | 66/170 |
| 4,298,680 | 11/1981 | Bruno | 430/300 |
| 4,303,721 | 12/1981 | Rodriguez | 428/213 |
| 4,378,622 | 4/1983 | Pinkston et al. | 29/148.4 |
| 4,548,858 | 10/1985 | Meadows | 428/224 |
| 4,554,040 | 11/1985 | van der Velden | 101/375 |
| 4,685,393 | 8/1987 | Saueressig | 101/375 |
| 4,812,357 | 3/1989 | O'Rell et al. | 428/246 |
| 4,903,597 | 2/1990 | Hoage et al. | 101/401.1 |

FOREIGN PATENT DOCUMENTS

| | | | |
|---|---|---|---|
| 2026954 | 4/1991 | Canada . | |
| 1217981 | 12/1960 | Fed. Rep. of Germany . | |
| 0132771 | 11/1978 | Fed. Rep. of Germany | 101/217 |
| 200937 | 11/1978 | Fed. Rep. of Germany . | |
| 2816703 | 10/1979 | Fed. Rep. of Germany . | |
| 0388740 | 3/1990 | Fed. Rep. of Germany . | |
| 2024104 | 1/1980 | United Kingdom . | |

OTHER PUBLICATIONS

European Search Report.

*Primary Examiner*—Edgar S. Burr
*Assistant Examiner*—Lynn D. Hendrickson
*Attorney, Agent, or Firm*—Craig K. Leon; William L. Baker

[57] ABSTRACT

The present invention relates to a cylinder covered with a printing blanket. According to the invention the layered structure of the blanket is such that the blanket is held onto the cylinder while fully surrounding this cylinder without any gap in the manner of a sleeve. This cylinder together with the printing sleeve is applicable in any type of offset printing machine.

13 Claims, 1 Drawing Sheet

AXIALLY SYMMETRICAL GAPLESS LAYERED SLEEVE PRINTING BLANKET SYSTEM

BACKGROUND OF THE INVENTION

The subject matter of the present invention essentially is a cylinder lined with a printing blanket and which may be used in printing machines of various types.

It is known long since to use in offset printing machines cylinders covered with a blanket allowing the printing of a paper web pinched and driven between two cylinders.

Until now the blankets were secured onto the cylinders by their ends which ends were entered and locked into the cylinder thereby resulting in a number of inconveniences.

The confronting ends of the blanket indeed necessarily left a certain space therebetween so that the paper web exhibited unprinted areas.

Moreover this way of securing the blankets imparted to the cylinder- blanket assembly a dissymmetry which as is well understood generated vibrations during the rotation of the cylinder. The speed and the output efficiency of the printing machines were therefore necessarily limited.

SUMMARY OF THE INVENTION

The object of the present invention is to propose a cylinder covered with a blanket coping with all these inconveniences.

For that purpose the subject matter of the invention is a cylinder lined with a printing blanket, characterized in that the layered structure of the blanket is such that the blanket is held on the cylinder while fully surrounding this cylinder without any gap in the manner of a sleeve.

Thus the symmetry upon rotation of the cylinder will be perfect and the printing machine comprising such cylinders will be capable of operating at high speed.

According to another characterizing feature of the invention the aforesaid blanket or sleeve comprises a base or inner layer of cellular rubber adhered on one side onto the outer surface of the cylinder and associated on the other side with other layers excluding the fabrics and comprising at least one hard layer of elastomer itself associated with a lithographic or printing layer.

It should be specified here that the hard layer of elastomer may be reinforced with fibers.

According to still another characterizing feature of the invention the aforesaid base layer has a thickness lying between about 0.1 and 8 mm and is made fast with the outside surface of the cylinder by a layer of adhesive with a thickness lying between about 0.01 and 0.2 mm and the aforesaid hard layer of elastomer has a thickness lying between about 0.05 and 0.5 mm.

According to still another characterizing feature of the invention the modulus of elasticity in compression of the layer of cellular rubber is lying between about 0.1 and 100 megapascals (MPa).

It should further be specified here that the percentage of volume and of gas enclosed within the layer of cellular rubber preferably in closed cells is lying between about 10 and 80%.

Now further characterizing features and advantages of the invention will appear better in the detailed description which follows and refers to the annexed drawings given by way of example only and wherein:

DETAILED DESCRIPTION OF PREFERRED EMBODIMENTS

Figure 1:
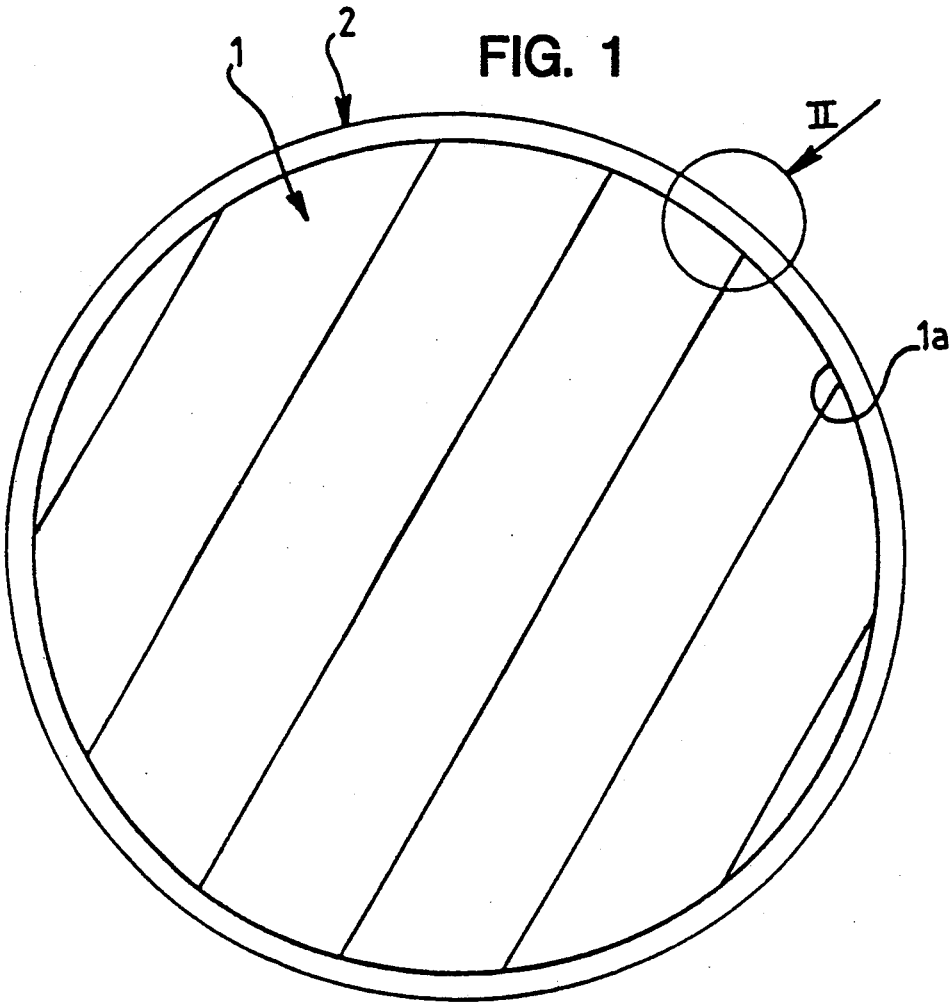
FIG. 1 is a diagrammatic view in cross-section of a cylinder covered with a sleeve-like printing blanket according to the principles of the invention.

Referring to this FIG. 1 there is seen a blanket-carrying cylinder 1 which is solid but which could also be hollow, this cylinder being covered with a blanket 2 which exhibits the shape of a sleeve fully surrounding the said cylinder without any gap.

The blanket or sleeve 2 may be fitted by any suitable method onto the cylinder 1 which may exhibit a diameter lying between 80 and 800 mm.

Figure 2:
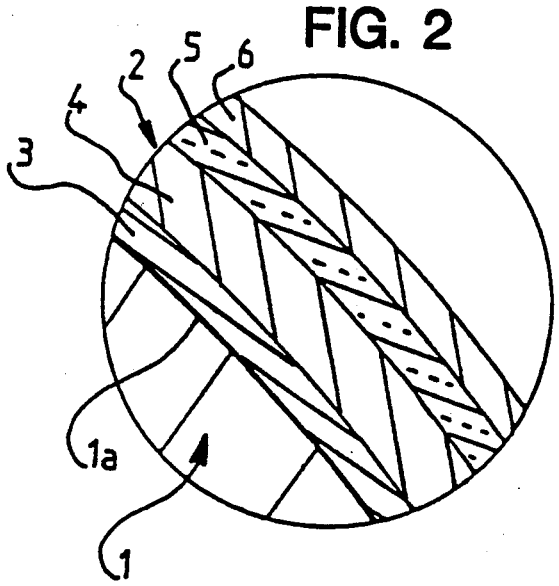
FIG. 2 is an enlarged view in section of the cylinder-blanket assembly according to the framed portion II of FIG. 1.

There will now be described the structure of the printing sleeve or blanket 2 with reference more particularly to FIG. 2.

The sleeve 2 comprises a base or inner layer 4 of cellular rubber adhered onto the outer surface of the cylinder 1 by a coating of adhesive 3 the thickness of which may lie between about 0.01 and 0.2 mm.

The layer 4 of cellular rubber has a thickness lying between 0.1 and 8 mm and a modulus of elasticity preferably lying between about 0.1 and 100 MPa. This layer 4 is compressible of course and contains a certain volume of gas enclosed within the open or closed cells. The percentage of gas volume enclosed within the cells may lie between about 10 and 80%. It should be noted that the layer 4 may optionally be reinforced with fibers or the like.

Over this layer 4 is adhered a layer 5 of hard elastomer which may possibly be reinforced with fibers. The thickness of this layer 5 of hard elastomer may lie between 0.05 and 0.5 mm.

At last the blanket or sleeve 2 comprises an outer lithographic or printing layer 6 which may have a thickness lying between 0.05 and 0.6 mm. This lithographic layer 6 is made from a suitable elastomeric material as known per se.

All the above-mentioned layers of the printing sleeve or blanket 2 are adhered to each other and to the outside surface of the cylinder 1 which as may be well understood by referring again to FIG. 1 forms together with the sleeve 2 a unit with a perfect rotational symmetry and which therefore does not generate any vibration and allowing a printing machine fitted with such cylinders to operate at a high speed.

The invention is of course not at all limited to the embodiment described and illustrated which has been given by way of example only.

On the contrary the invention comprises all the technical equivalents of the means described as well as their combinations if the latter are carried out according to its gist.

I claim:

1. A printing blanket comprising:

a sleeve for mounting around a cylinder, said sleeve being gapless for rotational symmetry thereby minimizing vibration at high speeds, said sleeve comprising a gapless inner layer of cellular rubber operative for disposition around an outer surface of a cylinder, a gapless hard elastomeric layer disposed around said inner layer, and a gapless printing layer disposed around said hard elastomeric layer, said printing layer being operative to print ink onto paper.

2. The printing blanket of claim 1 wherein said printing layer is operative for offset lithography.

3. The printing blanket of claim 1 wherein said hard elastomeric layer is reinforced with fibers.

4. The printing blanket of claim 1 wherein said hard elastomeric layer has a thickness between 0.05 and 0.5 mm.

5. The printing blanket of claim 1 wherein said inner layer has a thickness of between 0.1 and 8 mm.

6. The printing blanket of claim 1 wherein said inner layer of cellular rubber has a modulus of elasticity in compression between 0.1 and 100 megapascals.

7. The printing blanket of claim 1 wherein said inner layer is comprised of closed cells.

8. The printing blanket of claim 1 wherein said inner layer is comprised of closed cells containing a gas volume between 10 and 80 volume percent.

9. The printing blanket of claim 1 further comprising a layer of adhesive operative to secure said inner layer to a cylinder.

10. The printing blanket of claim 1 wherein said printing layer has a thickness between 0.05 and 0.6 mm.

11. The printing blanket of claim 1 wherein said inner layer is adhered to a cylinder.

12. The printing blanket of claim 1 wherein said inner layer is reinforced with fibers.

13. The printing blanket of claim 1 wherein said printing layer is operative for lithography.

* * * * *